United States Patent [19]

Morrill

[11] 4,197,054

[45] Apr. 8, 1980

[54] FAN BLADE ATTACHMENT FOR FAN MOTOR

[76] Inventor: Wayne J. Morrill, 3448 S. Washington Rd., Ft. Wayne, Ind. 46804

[21] Appl. No.: 834,124

[22] Filed: Sep. 19, 1977

[51] Int. Cl.[2] ..... F04D 29/34

[52] U.S. Cl. ..... 416/93 R; 416/135; 416/214 R

[58] Field of Search ..... 416/135, DIG. 3, 134 R, 416/206, 93 R, 169 A, 214 R; 417/353, 354; 403/397, 155, 329, 353, 261

[56] References Cited

U.S. PATENT DOCUMENTS

| | | | |
|---|---|---|---|
| 1,057,282 | 3/1913 | Schaeffer | 417/353 |
| 2,410,832 | 11/1946 | McLean | 416/206 |
| 2,497,804 | 2/1950 | Stearns | 403/353 X |
| 2,653,459 | 9/1953 | Morrill | 416/134 X |
| 2,742,223 | 4/1956 | Font | 417/354 |
| 2,819,703 | 1/1958 | Suttle | 416/169 A X |
| 2,906,349 | 9/1959 | Hans et al. | 416/135 |
| 3,002,365 | 10/1961 | Liljequist | 416/134 X |
| 3,367,687 | 2/1968 | Jenkins | 403/261 |
| 3,468,565 | 9/1969 | Roder | 403/261 X |

FOREIGN PATENT DOCUMENTS

| | | | |
|---|---|---|---|
| 868039 | 2/1953 | Fed. Rep. of Germany | 417/353 |
| 762625 | 3/1954 | Fed. Rep. of Germany | 416/DIG. 3 |
| 2325233 | 12/1973 | Fed. Rep. of Germany | 403/353 |
| 127355 | 6/1916 | United Kingdom | 416/DIG. 3 |
| 809698 | 3/1959 | United Kingdom | 416/DIG. 3 |
| 1169141 | 10/1969 | United Kingdom | 416/DIG. 3 |

*Primary Examiner*—Everette A. Powell, Jr.
*Attorney, Agent, or Firm*—Gust, Irish, Jeffers & Hoffman

[57] ABSTRACT

A fan blade is attached to the shaft of an induction motor by means of a spring clip seated in a groove in the shaft resiliently and frictionally clamping the fan blade against a flat surface of a member secured to the shaft, such as the rotor end ring, thereby providing a perpendicular relationship between the fan blade and shaft and, when the end ring is used, abstracting heat from the rotor.

3 Claims, 5 Drawing Figures

FAN BLADE ATTACHMENT FOR FAN MOTOR

BACKGROUND OF THE INVENTION

1. Field of the Invention

This invention relates generally to fan motors used in air moving applications, such as in refrigeration apparatus, and more particularly to attachment of a fan blade to a motor shaft.

2. Description of the Prior Art

Shaded pole and capacitor induction motors have long been used for driving fans, such as condenser fans in refrigeration systems, the fan blade typically being connected directly to the rotor shaft. In one common type of fan motor, the rotor laminations are mounted on a die cast aluminum hub, the fan blade being in engagement with the end of the hub and maintained perpendicular to the shaft thereby. In that prior construction, the fan blade is secured on the shaft by a Speed Nut threaded on the end of the shaft and is driven by a drive pin located in a hole drilled in the end of the hub.

Shaded pole and capacitor fan motors are now available, such as those described in my Pat. No. 4,045,698, in which the hub of the rotor is too small adequately to maintain the fan blade perpendicular to the motor shaft and further, since the hub is made of steel rather than die cast aluminum, it does not serve to conduct the rotor heat to the aluminum fan as well as the larger, aluminum hub of the prior motors. It is therefore desirable to provide a frictional fan blade attachment which will maintain the requisite perpendicular relationship of the fan blade with the shaft without relying on engagement with the rotor hub, which will provide good conductivity of rotor winding heat to the fan blades, and which eliminates the threaded shaft end, speed nut and drive pin employed in prior motors. Frictional drive of the fan blade not only eliminates the difficult-to-watch fan blade drive pin hole and drive pin, but also eliminates the possibility of loosening the retaining nut which can happen in case a small amount of rotation occurs between the nut and shaft, or in the case of a reversible motor.

SUMMARY OF THE INVENTION

In accordance with the broader aspects of the invention, an impeller blade is secured to a shaft by means of a spring member removably secured to the shaft which resiliently and frictionally clamps the blade against a flat surface of a member secured to the shaft and which is perpendicular thereto, such as an end ring of an induction motor rotor, thus maintaining the blade perpendicular to the shaft and, when the end ring is used, providing good conductivity of heat from the rotor winding to the blade.

It is accordingly an object of the invention to provide improved means for attaching an impeller blade to a shaft.

Another object of the invention is to provide improved means for attaching a fan blade to a motor shaft in which the fan blade is maintained perpendicular to the shaft and good conductivity of heat from the rotor winding to the fan blade is provided.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
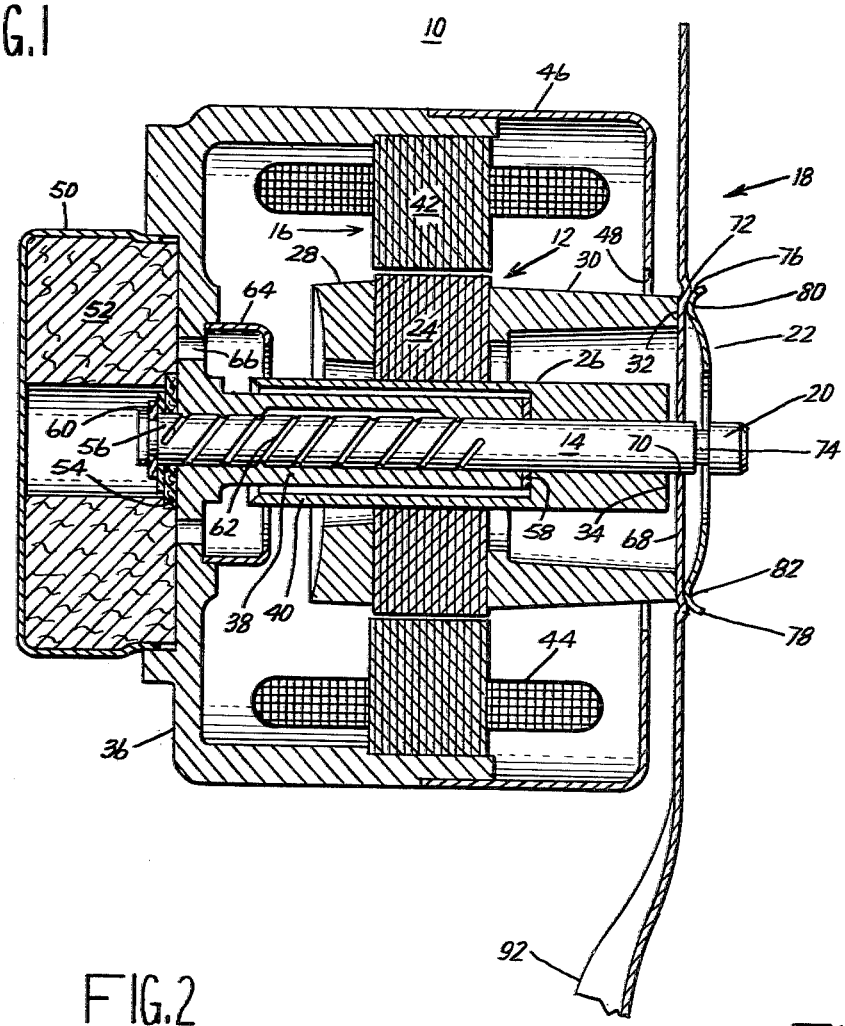
FIG. 1 is a side cross-sectional view showing the improved fan blade attachment of the invention.
Figure 2:
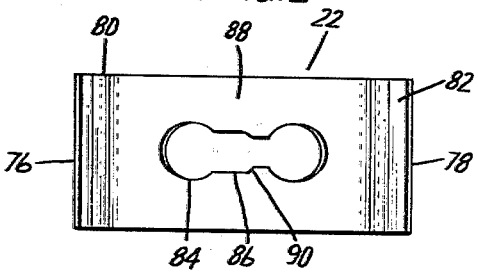
FIG. 2 is a side view of the spring clip member of the invention.

Referring now to FIG. 1, a shaded pole induction motor is shown, generally indicated at 10, which may be of the type shown and described in my U.S. Pat. No. 4,045,698. Motor 10 includes rotor assembly 12 mounted on shaft 14 and stator assembly 16. Air impeller or fan blade 18, which may be of the type shown and described in my U.S. Pat. No. 3,951,611, is secured to end 20 of shaft 14 by spring clip member 22 of the invention, as will hereinafter be more fully described.

Rotor member 12 includes laminations 24 mounted on steel hub 26 secured to shaft 14. Rotor 12 includes a die cast aluminum squirrel cage winding (not shown) having end rings 28, 30. End ring 30 surrounds hub 26 and shaft 14 and its end 32 extends axially beyond end 34 of hub 26. Frame member 36, conventionally formed of cast iron, has bearing post 38 in which shaft 14 is rotatably journaled. As best seen in FIG. 1, hub 26 includes sleeve portion 40 surrounding bearing post 38. Stator assembly 16 includes stator laminations 42 mounted in casing 36 surrounding rotor laminations 24 and having field coils 44 thereon. Cap 46 is secured to casing 36 to complete the closure for stator assembly 16 and has opening 48 therein through which end ring 30 extends, as shown.

Lubricant reservoir cap 50 is attached to casing 36 and accommodates lubricant-absorbant wick material 52. Feeder wick 54 surrounds end 56 of shaft 14 and feeds lubricant thereto from reservoir wick 52. End bump washer 58 is positioned on shaft 14 between the end of bearing hub 38 and rotor hub 26, and snap-ring 60 on end 50 of shaft 14 maintains shaft 14 and rotor assembly 12 in assembled relation on bearing post 38. Lubricant from feeder wick 54 and reservoir wick 52 is carried along shaft 14 by oil grooves 62. Lubricant which is carried through the bearing by oil grooves 62 is carried back along the interior surface of sleeve portion 40 of rotor hub 26, is thrown outwardly by centrifugal force against shield 64, and is returned to reservoir wick 52 through openings 66 in casing 36.

The construction thus far described is conventional in shaded pole motors and does not form a part of the present invention. The invention is equally applicable to other types of induction motors, such as capacitor motors.

In accordance with the present invention, fan blade 18, preferably formed of relatively thin sheet aluminum, has central portion 68 with central opening 70 therein having a slip fit with shaft 14. Central portion 68 of fan blade 18 has annular rib 72 formed therein concentric with opening 70 and having a diameter slightly greater than the outside diameter of end ring 30 at its end 32; rib 72 may alternatively be slightly smaller than the inside diameter of end 32 of end ring 30.

Figure 3:
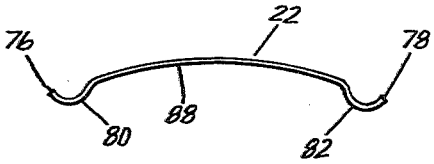
FIG. 3 is a side view of the spring clip member of FIG. 2.

Annular groove 74 is formed in end 20 of shaft 14. Spring clip member 22 is formed of suitable relatively thin spring steel and is normally bowed between its opposite ends 76, 78, as shown in FIG. 3. Curved portions 80, 82 are formed in spring clip member 22 adjacent its ends 76, 78. Opening 84 is formed in spring clip member 22 and communicates with narrower opening 86 in portion 88 intermediate ends 76, 78. Opening 84 is slightly larger than the outside diameter of end 20 of shaft 14 while the width of opening 86 is slightly smaller than the outside diameter of shaft end 20 but slightly wider than the diameter of the base of groove 74, which permits spring clip member 22 to be assembled over end 20 of shaft 14 and then moved laterally so that opening 86 is seated in groove 74. Bottom 90 of opening 86 of spring clip member 22 limits the movement of spring clip member 22 after opening 86 is seated in groove 74.

When assembled on end 20 of shaft 14 as above-described, curved portions 80, 82 of spring clip member 22 engage central portion 68 of fan blade 18 and rib 72 resiliently clamping fan blade 18 against end 32 of end ring 30, thus providing the requisite perpendicular relationship of fan blade 18 with shaft 14, and providing good conduction of the heat in the squirrel cage winding of rotor 12 to blades 92 of fan 18.

It will be observed that the necessity for providing threads on the end of shaft 14 and a drilled hole to accommodate a drive pin is eliminated in the present invention, and that spring clip member 22 can readily be assembled and disassembled on end 20 of shaft 14 by hand. It will further be observed that annular rib 72 on fan blade 18 serves to retain spring clip member 22 in its final position.

Figure 4:
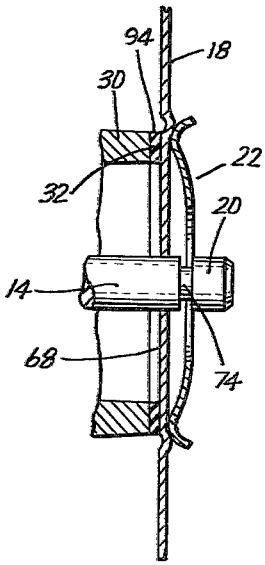
FIG. 4 is a fragmentary side cross-sectional view showing a modification of the invention.

Referring now to FIG. 4 in which like elements are indicated by like reference numerals, an annular elastic member 94 may be positioned between end 32 of end ring 30 and central portion 68 of fan blade 18 in order to provide noise isolation. It has been found that interposing elastic ring 94 between end ring 30 and fan blade 18 does not detract appreciably from the ability to conduct heat from the rotor winding to the fan blade. It will be understood that ring 94 need not be a separate part, but may be formed by dipping the end ring in suitable elastic material, such as vinyl chloride. Alternatively, ring 94 may be coated on fan blade 18. Curved portions 80, 82 of spring clip 22 may also be coated with elastic material to eliminate metal-to-metal contact.

Figure 5:
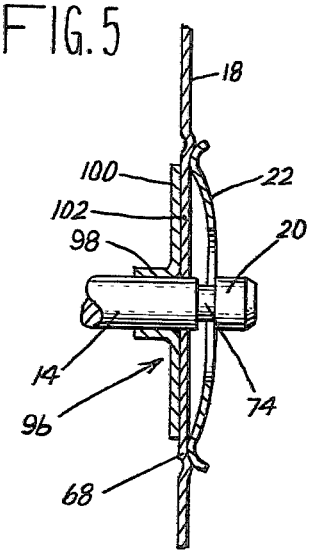
FIG. 5 is a fragmentary side cross-sectional view showing a further modification of the invention.

Referring now to FIG. 5 in which like elements are still indicated by like reference numerals, fan blade 18 may be clamped by spring clip member 22 against flat surface 102 of annular flange portion 100 of member 96 which has hub portion 98 pressed on shaft 17, surface 102 being perpendicular to shaft 14.

While the invention has been described in connection with an impeller or fan blade, it will be readily understood that it is equally applicable to a water impeller blade.

While there have been described above the principles of this invention in connection with specific apparatus, it is to be clearly understood that this description is made only by way of example and not as a limitation to the scope of the invention.

What is claimed is:

1. In the combination of a rotatable shaft, a member secured to said shaft and having an annular surface defining a plane perpendicular to the axis thereof, and an impeller blade including a central portion having a central opening therein with said shaft extending therethrough, said blade portion having one side abutting said surface; the improvement wherein said shaft has an annular groove formed therein axially spaced outwardly from said central portion of said blade, and comprising an elongated leaf spring member having opposite ends and an opening formed therethrough intermediate said ends, said opening having a first portion larger than the diameter of said shaft for receiving the same thereby permitting assembly of said spring member on said shaft, said opening having a second portion communicating with said first portion and narrower than said shaft diameter but wider than the diameter of the base of said groove, said spring member being mounted on said shaft with said second opening portion thereof seated in said groove, said spring member being normally bowed between said ends toward said blade portion, portions of said spring member respectively adjacent said ends thereof engaging said central portion of said blade thereby resiliently and frictionally clamping the same against said surface of said member for driving said blade, said blade portion having an annular rib concentric with said central opening thereof, said surface abutting said blade portion radially inwardly from said rib, said spring member having curved sections which respectively terminate at said ends, said curved sections engaging said rib; said first-named member being the rotor member of an induction motor, said rotor member having an end ring extending from one side thereof and surrounding one end of said shaft, said end ring having an end axially spaced from said rotor member side, said end ring end being said surface, said one shaft end having a portion extending beyond said end ring end, said blade being a fan and being mounted on said shaft portion.

2. In the combination of a rotor member for an induction motor mounted on a rotatable shaft, said rotor member having an annular end ring extending axially from one side thereof and surrounding said shaft, said end ring having an annular end surface defining a plane perpendicular to the axis of said shaft, said shaft having a portion extending axially beyond said end ring, and a fan blade including a central portion having a central opening therin with said shaft extension portion extending therethrough, said central portion of said fan blade having opposite sides with one side abutting said end ring end surface, said shaft extension portion having an annular groove therein spaced axially outwardly from the other side of said central portion of said fan blade; an elongated leaf spring member having opposite sides and ends and an opening formed therethrough intermediate said ends, one side of said spring member having indentations formed therein respectively adjacent said ends, said indentations respectively forming outwardly curved sections on the other side of said spring member, said opening having a first portion larger than the diameter of said shaft for receiving the same thereby permitting assembly of said spring member on said shaft, said opening having a second portion communicating with said first portion and narrower than said shaft diameter but wider than the diameter of the base of said groove, said spring member being mounted on said shaft extension portion with said second opening portion thereof seated in said groove and with said other side facing said fan blade, said spring member being normally bowed between said ends away from said fan blade, said curved sections of said spring member engaging the other side of said central portion of said fan blade substantially directly opposite said end ring end surface thereby resiliently and frictionally clamping said fan blade against said end ring end surface for driving said fan blade and abstracting heat from said rotor member.

3. The combination of claim 2 further comprising a ring of elastic material disposed between said end ring end and said one side of said central portion of said fan blade.

* * * * *